US006435914B1

(12) United States Patent
Billman

(10) Patent No.: US 6,435,914 B1
(45) Date of Patent: Aug. 20, 2002

(54) ELECTRICAL CONNECTOR HAVING IMPROVED SHIELDING MEANS

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/893,815

(22) Filed: Jun. 27, 2001

(51) Int. Cl.[7] ..... H01R 13/648
(52) U.S. Cl. ..... 439/608
(58) Field of Search ..... 439/608, 79, 701, 439/108

(56) References Cited

U.S. PATENT DOCUMENTS 5,664,968 A * 9/1997 Mickievicz ..... 439/608
5,860,816 A * 1/1999 Provencher et al. ..... 439/79
5,980,321 A * 11/1999 Cohen et al. ..... 439/608
5,993,259 A * 11/1999 Stokoe et al. ..... 439/608
6,146,202 A * 11/2000 Ramey et al. ..... 439/608
6,238,245 B1 * 5/2001 Stokoe et al. ..... 439/608

* cited by examiner

*Primary Examiner*—Gary Paumen
(74) *Attorney, Agent, or Firm*—Wei Te Chung

(57) ABSTRACT

An electrical connector (1) comprises plural wafers (10) staked side-by-side, each of which includes a signal piece (11) and a shield piece (21) attached to the signal piece. The signal piece includes a dielectric body (12) and a plurality of signal terminals (14) retained in the dielectric body. The dielectric body defines a number of through slots (15) and a corresponding number of undercuts (16) corresponding to the through slots. The shield piece includes a metal plate (22) formed with a plurality of first ribs (23) and a corresponding number of second ribs (25) corresponding to the first ribs on opposite sides thereof for insertion into corresponding through slots and undercuts, respectively. Lower tip ends (234) of the first ribs and top tip ends (254) of the second ribs are overlapped or at least located on a common plane (20).

3 Claims, 8 Drawing Sheets

ELECTRICAL CONNECTOR HAVING IMPROVED SHIELDING MEANS

CROSS REFERENCE TO RELATED APPLICATIONS

This application is related to a U.S. patent application Ser. No. 09/852949, titled "Electrical Connector Having Different Pair Terminals With Equal Length" and commonly assigned to the same assignee of the present application, which is incorporated herein by reference.

BACKGROUND OF THE INVENTION

1. Field of the Invention

The present invention relates to an electrical connector used to interconnect printed circuit boards, and particularly to such an electrical connector which is provided with an improved shield means.

2. Description of Prior Art

Backplane connectors are commonly used in backplane systems to electrically interconnect a daughter board or an inserted card to a backplane or a mother board which are substantially located at a right angle with respect to each other for transmitting high speed signals or data between the two boards. A backplane connector generally comprises a receptacle connector, usually named as a pin header, mounted on a backplane, and a plug connector mounted on a daughter board for mating with the receptacle connector. Such backplane connectors are disclosed in U.S. Pat. Nos. 5,993,259, 5,860,816 and 5,980,321. A receptacle connector comprises a plurality of wafers stacked side-by-side and each wafer includes a dielectric body, a number of signal terminals integrally formed in the dielectric body and a conductive shield covering on the dielectric body for providing Electro Magnetic Interference (EMI) shielding for the signal terminals of adjacent wafers. With the development trend in computers, backplane connectors are becoming more and more miniature while transmitting signals or logics with higher and higher speed in backplane systems, therefore, signal terminals of the backplane connector are becoming higher and higher in density. Therefore, to effectively overcome EMI or cross talk between adjacent signal terminals of the backplane connector is an important issue. However, the above-mentioned U.S. patents only disclose EMI shielding for the signal terminals between adjacent wafers by the conductive shield, but do not disclose EMI shielding between adjacent signal terminals within each wafer. Hence, a backplane connector with improved EMI shielding is desired.

BRIEF SUMMARY OF THE INVENTION

A first object of the present invention is to provide an electrical connector which is provided with an excellent shielding function;

A second object of the present invention is to provide an electrical connector having a shielding mechanism which is easy manufactured and low in cost.

To fulfill the above-mentioned objects, an electrical connector in accordance with the present invention used in backplane systems comprises a plurality of wafers side-by-side staked with each other. Each Wafer includes a signal piece and a shield piece covered onto the signal piece. The signal piece is formed with a dielectric body and a plurality of signal terminals insert molded with the dielectric body. The dielectric body defines a plurality of through slots and a corresponding number of undercuts corresponding to the through slots both extending from one side to the other side thereof. The shield piece comprises a metal plate which is integrally formed with a plurality of first ribs and a corresponding number of second ribs corresponding to the first ribs formed through die-case for tightly insertion into corresponding through slots and undercuts of the signal piece, respectively. In addition, lower tip ends of the first ribs and top tip ends of the second ribs are overlapped or at least located on a common plane to effective block EMI among the signal terminals within each wafer.

Other objects, advantages and novel features of the invention will become more apparent from the following detailed description of the present embodiment when taken in conjunction with the accompanying drawings.

DETAILED DESCRIPTION OF THE INVENTION

Figure 3:
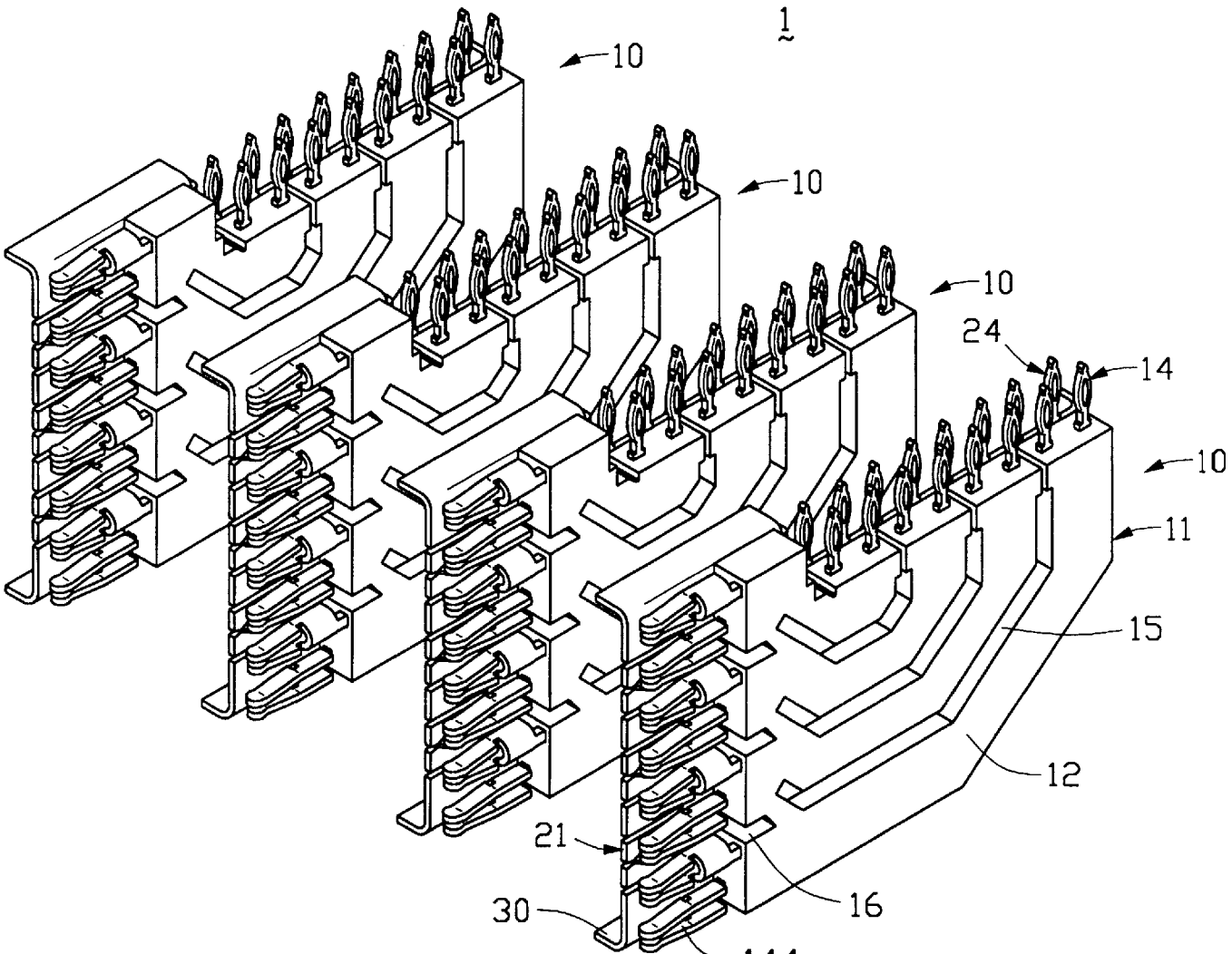
FIG. 3 is an exploded perspective view of an electrical connector in accordance with the first embodiment of the present invention.
Figure 4:
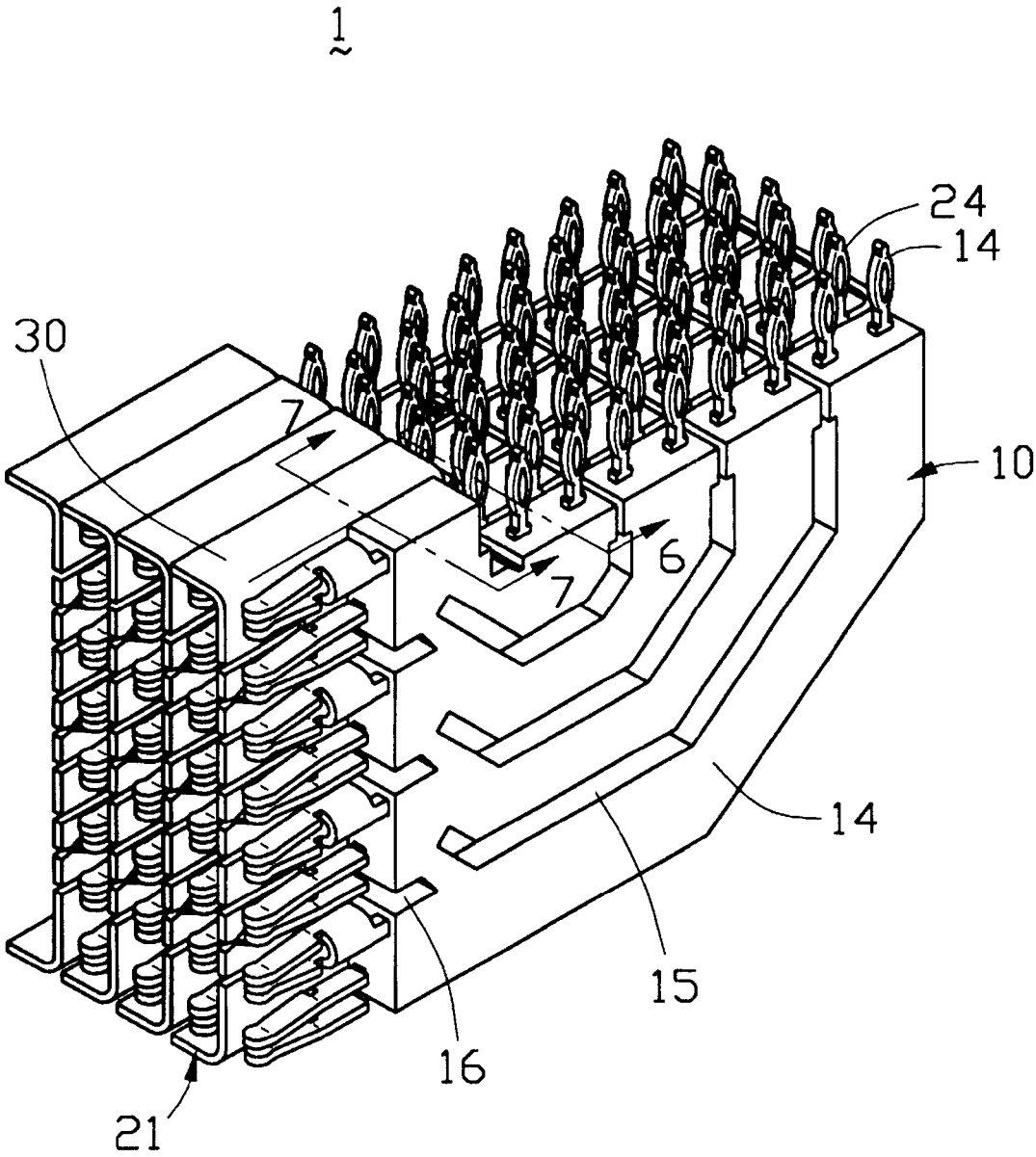
FIG. 4 is an assembled view of FIG. 3.

Reference will now be made to drawings, and first to FIGS. 3 and 4, an electrical connector 1 in accordance with the first embodiment of the present invention, generally named as plug connector, is used to be mounted on a daughter board (not shown). The connector 1 is adapted for mating with a header connector (not shown) mounted on a backplane or mother board located substantially at an right angle with respect to the daughter board, thereby electrically interconnecting the daughter and mother boards. The electrical connector 1 comprises multiple wafers 10 which have an identical structure with each other and are stacked together side by side. Thus, only one wafer 10 will be described below.

Figure 1:
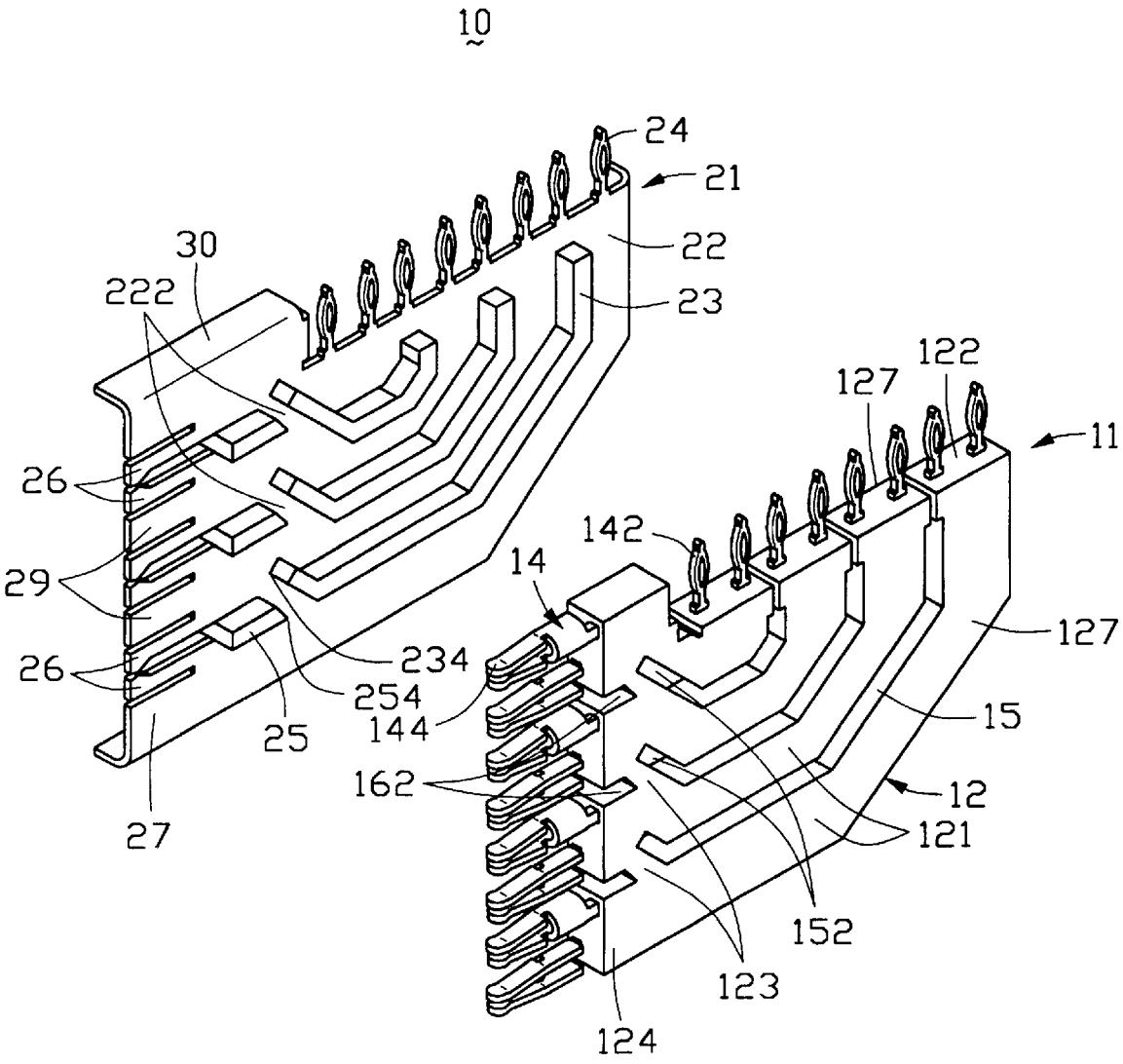
FIG. 1 is an exploded view of a unit of an electrical connector in accordance with the first embodiment of the present invention.
Figure 2:
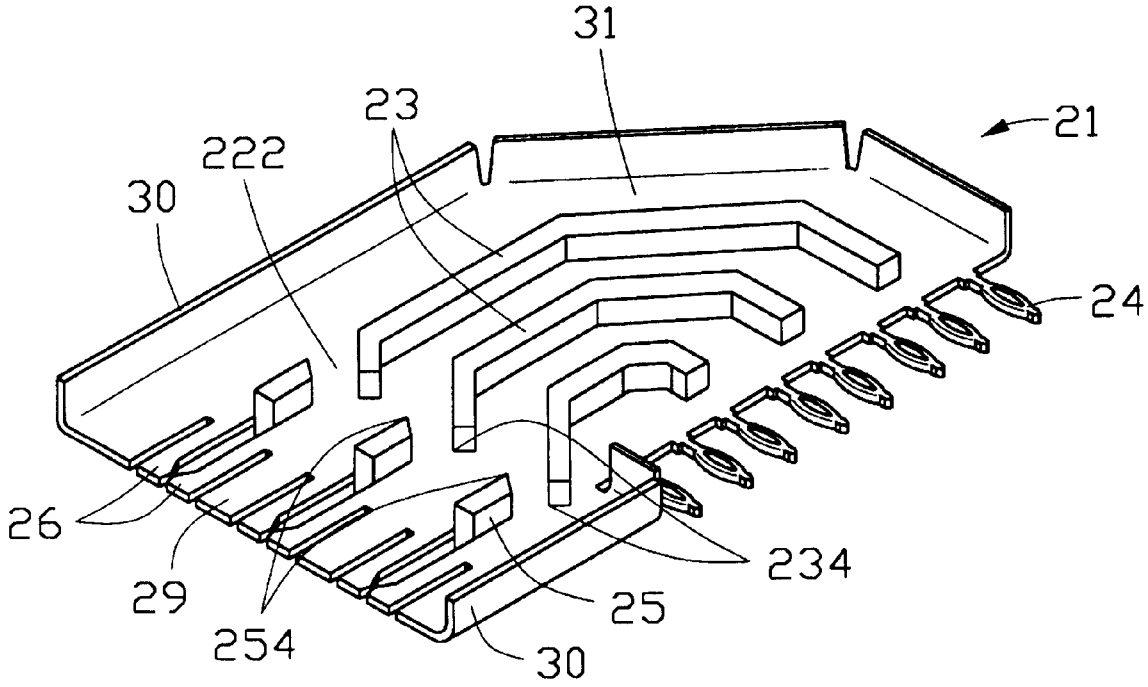
FIG. 2 is a perspective view of a shield piece of FIG. 1.

Referring to FIGS. 1 and 2, the wafer 10 includes a signal piece 11 and a shield piece 21 attached to the signal piece 11 for providing EMI shielding function. The signal piece 11 comprises a dielectric body 12 and a plurality of signal terminals 14 insert molded in the dielectric body 12. In the prefer embodiment of the present invention, there are total eight signal terminals 14 insert molded in each dielectric body 12 and each terminal 14 includes a retaining portion embedded in the dielectric body 12, a press-fit tail 142 and a fork-like mating portion 144 extending from opposite ends of the retaining portion, respectively. The detail of the signal terminal 14 is described in the application cross-referenced. The press-fit tail 142 extends beyond a side face 122 of the body 12 for insertion into a corresponding hole (not shown) defined in the daughter board, and the fork-like mating portion extends from a bottom face 124 of the body 12 for engaging with a corresponding terminal pin (not shown) of the header connector mounted on the mother board. The dielectric body 12 defines several through slots 15 extending through opposite side surfaces 127 thereof for dividing the body 12 into a corresponding number of sections. In the prefer embodiment of the present invention, there are three through slots 15 dividing the body 12 into four sections 121, each section 121 including two terminals 14 therein. The body 15 further defines three undercuts 16 corresponding to the three slots 15 at a bottom side 124 thereof and leaves a slim bridge 123 interconnecting each undercut 16 to a corresponding slot 15. Further referring to FIG. 5, bottom tips 152 of the slots 15 and top tips 162 of the undercuts 16 are substantially located on a common plane, designated as a dotted line 20, which is substantially vertical to the electrical connector 1.

Figure 5:
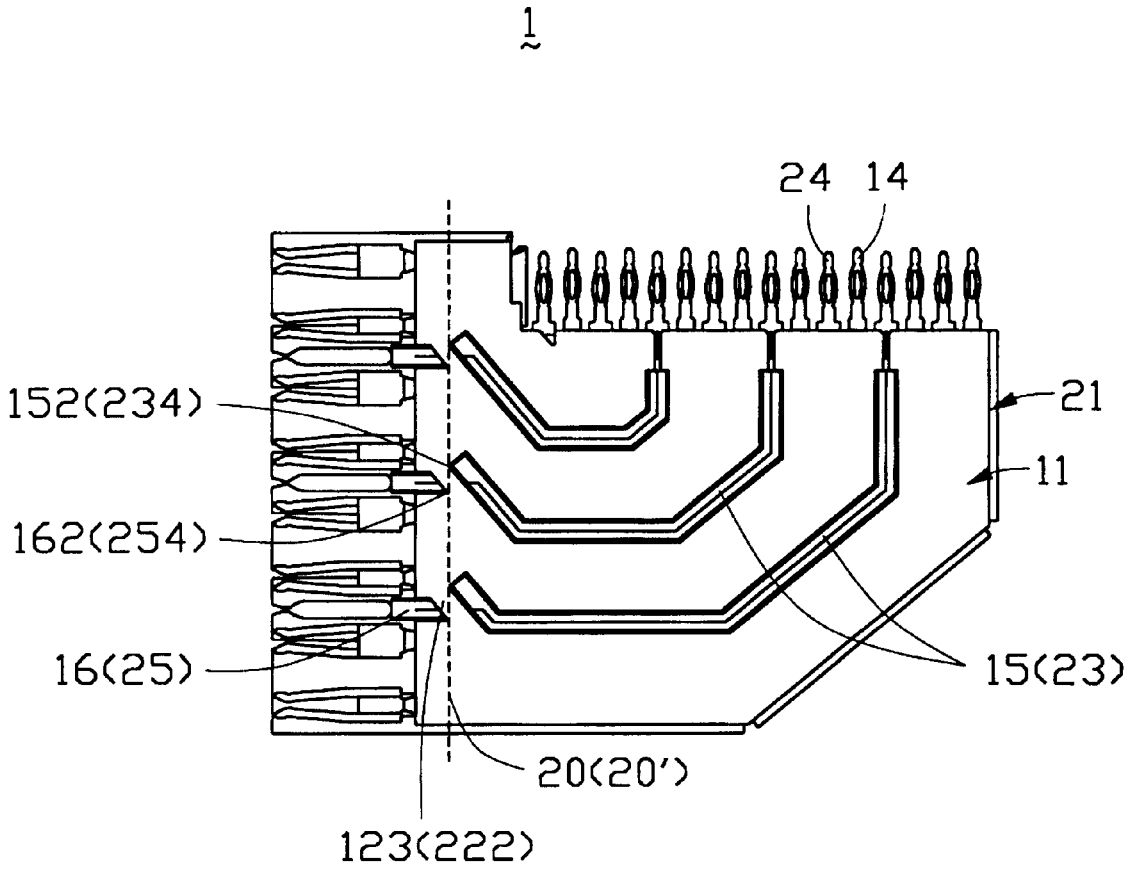
FIG. 5 is a front view of FIG. 4.
Figure 6:
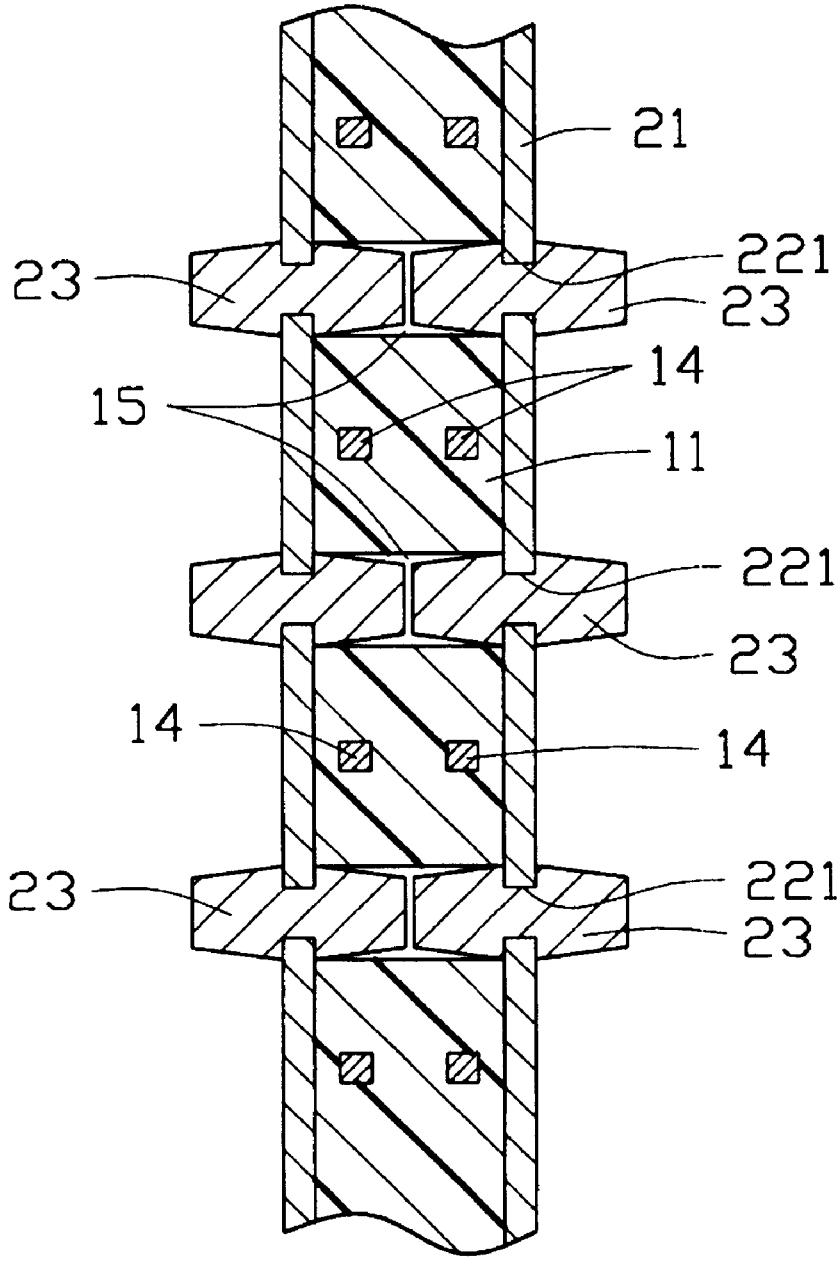
FIG. 6 is a cross-sectional view taken on line 6—6 of FIG. 4.
Figure 7:
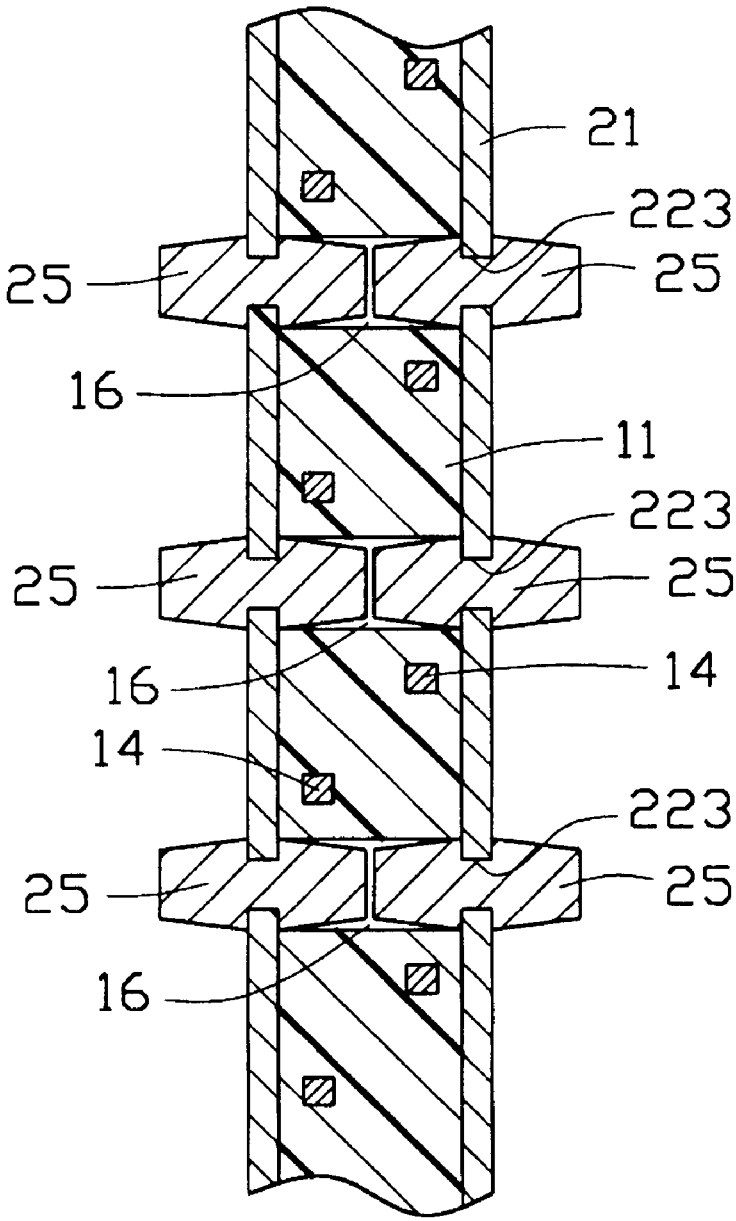
FIG. 7 is a cross-sectional view taken on line 7—7 of FIG. 4.

Referring to FIGS. 1 and 2 again, the shield piece 21 is stamped and formed from a metal sheet and is constructed in a structure corresponding to the signal piece 1. The shield piece 21 is formed with a metal plate 22 with a plurality of slits 221 and openings 223 corresponding to the contours of the slots 15 and undercuts 16, respectively, as shown in FIGS. 6 and 7. Then, each slit 221 or an opening 223 is further formed with a first rib 23 or second rib 25 through the die-cast molding. Further referring to FIGS. 5 to 7, the first ribs 23 and second ribs 25 have substantially the same structures as the slots 15 and the shorter slots 16, respectively, and both are symmetric about the metal plate 22 and have an identical width substantially equal to that of the slot 15 or the undercut 16. Thus, each first rib 23 or second rib 25 is inserted into substantially a half depth of a corresponding through slot 15 or undercut 16 of the signal piece 11. A passageway 222 is left between a lower tip 234 of each first rib 23 and an upper tip 254 of a corresponding second rib 25. The lower tips 234 of the first ribs 23 are located on a first common plane 20 and upper tips 254 of the second ribs 25 are located on a second common plane 20', wherein the first and second common planes 20, 20' are overlapped. A plurality of grounding tails 24, shaped in press-fit type, extend from a lateral side of the metal plate 22 for press-fitting into a corresponding grounding hole (not shown) defined in the daughter board. Several pairs of grounding legs 26 are formed on a bottom side 27 of the metal plate 22 for mating with corresponding grounding pins (not shown) of the mating header connector and are seperated from each other by a corresponding number of tabs 29. The metal plate 22 is further formed with a plurality of peripheral wedges(flanges) 30 substantially extending at an right angle with respect to the metal plate 22, thereby jointly defining a receiving space 31 for snugly covering on the signal piece 11.

In assembly, referring to FIGS. 3 to 7, each signal piece 11 and a corresponding shield piece 21 are first side-by-side assembled with each other with halves of the first ribs 23 or the second ribs 25 on one side opposite to the peripheral wedges 30 thereof being inserted into substantially half depth of a corresponding slot 15 or undercut 16 of the signal piece 11, resulting in each wafer 10. Then, the plural wafers 10 are side-by-side stacked together with halves of the first ribs 23 and second ribs 25 on the other side of each wafer 10 inserted into the other half depths of the corresponding slots 15 and shorter slots 16 of an adjacent wafer 10, respectively. Additionally, the peripheral wedges 30 of one wafer 10 is snugly covered on a corresponding signal piece 11 of the adjacent wafer 10, thereby forming the whole electrical connector 1, as shown in FIG. 4.

Using this arrangement, the electrical connector 1 in accordance with the present invention is provide with an excellent EMI shielding function for each wafer 10 thereof. As shown in FIG. 4, the signal pieces 11 are securely shielded from each other by the metal plates 22 of the shield pieces 21 arranged among them. Especially, further referring to FIGS. 6 and 7, within each signal piece 11, every two signal terminals 14 within each section 121 thereof are totally shielded from each other by the first ribs 23 and second ribs 25 of the two associated shield pieces 21 being totally blocked within a corresponding slot 15 and a undercut 16, respectively. Furthermore, as shown in FIG. 5, since the first ribs 23 and the corresponding second ribs 25 are located in the common plane 20, they totally shield cross-talk or EMI for the signal terminals 14 of each section 121 from each other.

Figure 8:
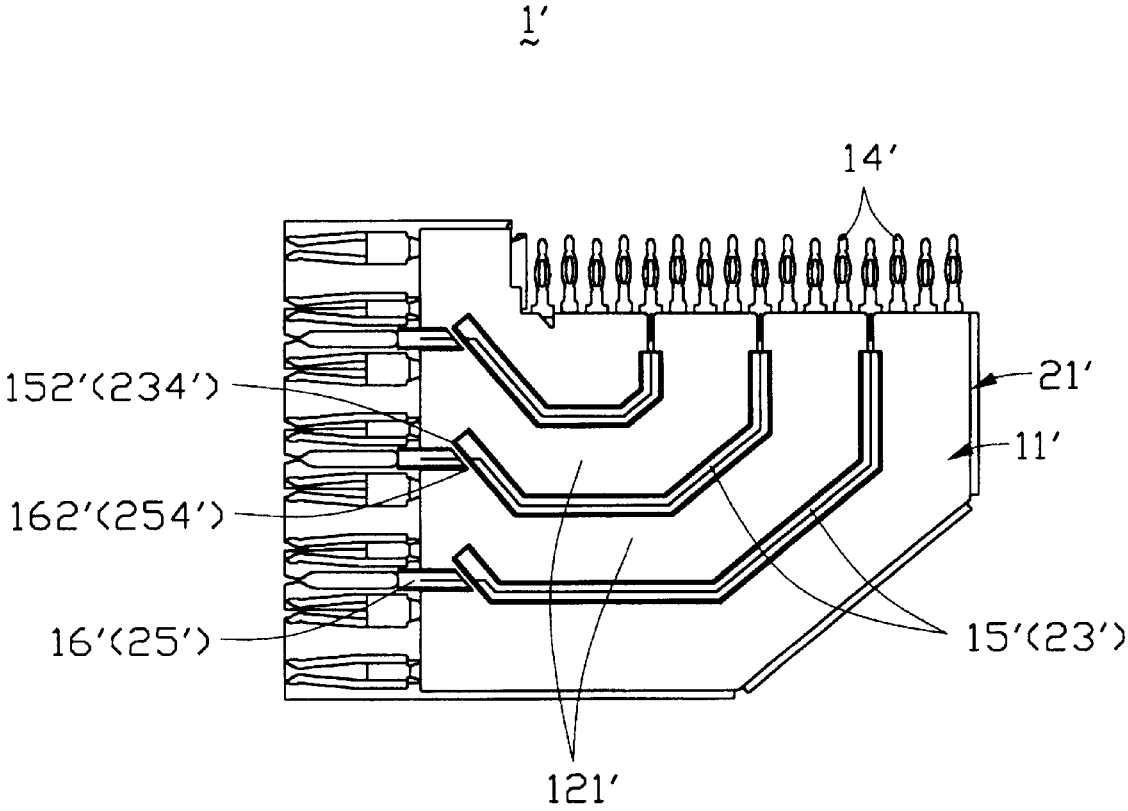
FIG. 8 is a front view of an electrical connector in accordance with a second embodiment of the present invention.

Referring to FIG. 8, an electrical connector 1' in accordance with a second embodiment of the present invention is shown. The electrical connector 1' has substantially the same structure as that of the electrical connector 1 except for slots 15' and undercuts 16' of the signal piece 11', and first and second ribs 23', 25' of the shield piece 21', thus only the different structures therebetween are illustrated hereinafter. Each slot (first rib) 15'(23') and a corresponding undercut (second rib) 16'(25') respectively have a lower tip end 152'(234') and an upper tip end 162 (254') which are overlapped to provide a more effective EMI or cross-talk shielding for the signal terminals 14' within each section 121' of the signal piece 11'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a signal piece having a dielectric body and a plurality of signal terminals integrally formed with the dielectric body, the dielectric body defining a plurality of through slots and a corresponding number of undercuts corresponding to the through slots for dividing the dielectric body into several sections, each section including at least one of the plurality of signal terminals; and a metal shield piece being covered onto one side of the signal piece and including a metal plate, a plurality of first ribs and a number of second ribs corresponding to the first ribs for insertion into corresponding through slots and undercuts of the signal piece, respectively; wherein lower tip ends of the first ribs and upper tip ends of the second ribs are overlapped or located on a common planes;

wherein the dielectric body has a linking portion between each through slot and a corresponding undercut;

wherein the through slots and the undercuts extend through two opposite side surfaces of the dielectric body of the signal piece;

wherein each of the first ribs and the second ribs of the shield piece extends beyond opposite side surfaces of the metal plate and is symmetric about the metal plate;

wherein the first ribs and the second ribs of the shield piece are formed through die-casting;

wherein the first ribs and the second ribs have a first identical width and the through slots and the undercuts also have a second identical width substantially equal to the first identical width;

wherein the metal plate further forms a plurality of peripheral walls to snugly cover on the signal piece.

2. An electrical connector comprising:

a signal piece including a dielectric body and a plurality of signal terminals insert molded in the dielectric body, each signal terminal having a retaining portion embedded in the dielectric body, a press-fit tail and a mating portion extending from opposite ends of the retaining portion and beyond the dielectric body, a plurality of through slots and a number of undercuts corresponding to the through slots extending through opposite side surfaces of the dielectric body and cooperatively dividing the signal piece into several sections, each section including at least one of the plurality of signal terminals; and two metal shield pieces being side-by-side covered on opposite side surfaces of the signal piece and being formed with a plurality of first ribs and a corresponding number of second ribs for face-to-face insertion into corresponding through slots and undercuts of the signal piece, respectively, thereby effectively providing electromagnetic interference shielding for the at lease one of the plurality of signal terminals of each section of the signal piece from each other; wherein lower tips of the first ribs are located on a first common plane and upper tips of the second ribs are also located on a second common plane, wherein the first and second common planes are overlapped for shielding adjacent signal terminals from each other.

3. In combination, a series of planar signal pieces and shield pieces alternately arranged with one another in a side-by-side manner, each of said signal pieces including a dielectric body with plural pairs of signal terminals therein, and a plurality of through slots extending therethrough in a direction perpendicular to the planar signal piece, said through slots separating each of the pairs of signal terminals from others, each of said shield pieces including a metal plate with a plurality of peripheral flanges perpendicularly extending, in a first direction, from the edges of the metal plate to commonly define a receiving space for receiving the signal piece by one of two sides of the shield piece, and a plurality of ribs extending, in a second direction opposite to said first direction, from an interior region of the metal plate with configuration and dimension corresponding to those of the through slots of the signal piece by the other of said two sides of the shield piece and received in said corresponding through slots, respectively; wherein the flanges of said each of the shield pieces isolate external EMI from the signal piece positioned by said one of the two sides thereof, while the ribs of said each of the shield pieces isolate internal EMI among said pairs of signal terminals from the signal piece positioned by said other of the two sides thereof.

* * * * *